United States Patent [19]

Tupper

[11] Patent Number: 4,887,713

[45] Date of Patent: Dec. 19, 1989

[54] WINDOW WASHER CADDY

[76] Inventor: Donna D. Tupper, 74 Tuck Rd., Manchester, Conn. 06040

[21] Appl. No.: 237,549

[22] Filed: Aug. 29, 1988

[51] Int. Cl.[4] ..... B65D 69/00

[52] U.S. Cl. ..... 206/225; 206/229; 206/230

[58] Field of Search ..... 206/225, 229, 230, 233, 206/373

[56] References Cited

U.S. PATENT DOCUMENTS

| | | | |
|---|---|---|---|
| 3,618,749 | 11/1971 | Vaccaro | 206/16 |
| 3,887,103 | 6/1975 | Spooner | 206/373 X |
| 4,280,643 | 7/1981 | Cordova et al. | 294/141 |
| 4,475,660 | 10/1984 | Cain | 211/113 |
| 4,516,676 | 5/1985 | Cournoyer | 206/226 |
| 4,613,041 | 9/1986 | Carlton | 206/373 |

*Primary Examiner*—Allen M. Ostrager
*Attorney, Agent, or Firm*—Richard A. Craig

[57] ABSTRACT

A window washer caddy includes a box having a bottom providing an internal floor, opposed ends and opposed sides and an open top. A partition has a carrying aperture and divides the box into first and second portions. A spindle has a lower end secured to the floor at a location within the first portion and projects upwardly from the floor to an upper free end for receiving thereon and holding a roll of paper towels. The first portion also provides space for a conventional bottle of window washing liquid, and the second portion provides space for used paper towels. A pair of spaced hooks provide for releasably hanging the caddy from a rung of a ladder.

5 Claims, 1 Drawing Sheet

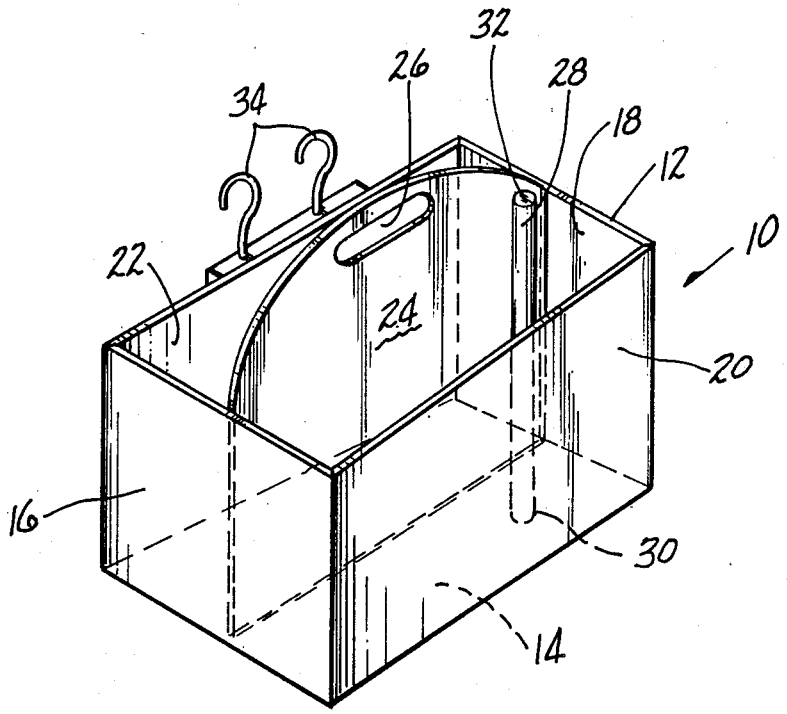
32
26
28
34
18
12
10
22
24
20
16
30
14

WINDOW WASHER CADDY

BACKGROUND OF THE INVENTION

This invention relates to a window washer caddy which facilitates the cleaning of windows. More particularly, the window washer caddy facilitates the cleaning of windows by holding the items used in the window washing process.

A patentability search hereon produced the following U.S. Patents:

| U.S. Pat. No. | Date | Inventor(s) |
|---|---|---|
| 3,618,749 | November 9, 1971 | Vaccaro |
| 4,280,643 | July 28, 1981 | Cordovo et al. |
| 4,475,660 | October 9, 1984 | Cain |
| 4,516,676 | May 14, 1985 | Cournoyer |
| 4,613,041 | September 23, 1986 | Carlton |

These prior patents teach various carriers, portable clean-up devices, caddies for janitorial supplies and portable cleaning and storing kits. However, they do not teach certain salient features of the present invention, as will be brought out hereinafter.

Accordingly, it is an important object of the invention to provide a window washer caddy for holding items used in the window washing function, while freeing both of a user's hands, especially while the user is standing on a ladder.

It is another important object of the invention to provide such a window washer caddy which is of simple and economical construction.

The above and other objects and advantages will appear more clearly hereinafter.

SUMMARY OF THE INVENTION

A preferred window washer caddy in accordance with the invention includes a box having closed bottom, ends and sides and an open top, and an internal partition with a carrying aperture.

The bottom provides the box with an internal floor and the partition divides the box into first and second portions. A cylindrical spindle is secured to and projects upwardly from the fllor in the first portion for receiving and holding thereon a roll of paper towels. The first portion also has a space to accommodate a bottle of liquid window cleaner. The second portion provides a receptacle for used paper towels. The caddy also is provided with a hook device at the upper edge of a side of the box, whereby the caddy can be releasably hung from a rung of a ladder.

DESCRIPTION OF THE DRAWING

The sole drawing FIGURE is a perspective view of a preferred window washer caddy embodying the invention. cDESCRIPTION OF THE INVENTION The drawing shows a preferred window caddy 10 embodying the invention.

Caddy 10 includes a box 12 having a closed rectangular bottom or floor 14, closed rectangular ends 16 and 18, closed rectangular sides 20 and 22 and an open top. Box 12 further has an internal partition 24 joining ends 16 and 18 and parallel to and spaced from sides 20 and 22. Partition 24 projects above the plane of the top edges of ends 16 and 18 and sides 20 and 22 and is provided with a carrying aperture 26.

Partition 24 divides box 12 into a first portion also defined by floor 14, ends 16 and 18 and side 20, and a second portion defined by floor 14, ends 16 and 18 and side 22.

Caddy 10 further comprises a cylindrical spindle 28 having a lower end 30 secured to floor 14 in the first portion of box 12 and projecting upwardly from floor 14 to an upper free end 32 above the plane defined by ends 16 and 18 and sides 20 and 22. Spindle 28 readily receives and holds a roll of paper towels (not shown).

Spindle 28 is located closer to end 18 than to end 16, so as to provide space between the unshown roll of paper towels on spindle 28 and end 16 for the reception of a conventional bottle of window washing liquid (not shown).

The second portion of box 12 is sized for ready reception therein of used paper towels (not shown).

Caddy 10 also includes, secured to the upper edge of side 22, a pair of spaced open hooks 34, whereby caddy 10 can be readily and releasably hung from a rung of a ladder (not shown).

Box 12, partition 24 and spindle 28 can be of any suitable material. Suitable material for box 12 and partition 24 includes plywood, among other materials, while suitable material for spindle 28 includes wooden doweling, among other material.

It is evident that the invention attains the stated objects and advantages and others.

The disclosed details are exemplary only and are not to be taken as limitations on the invention except as those details may be included in the appended claims.

What is claimed is:

1. A window washer caddy comprising a box including a bottom providing an internal floor, opposed ends and opposed sides and an open top, a partition having a carrying aperture and dividing said box into first and second portions, a spindle having a lower end secured to said floor at a location within said first portion and projecting upwardly from said floor to an upper free end for receiving thereon and holding a roll of paper towels, said first portion also adapted to receive therein a conventional bottle of window washing liquid, and said second portion being adapted to receive used paper towels, and a pair of spaced hooks for releasably hanging said caddy from a rung of a ladder, wherein said bottom is rectangular, said opposed ends are rectangular and said sides are rectangular and the edges of said ends and said sides remote from said bottom define a plane parallel to said bottom, and said partition extends between said ends and is parallel to said sides and has a smoothly curved upper edge with ends in said plane and a central portion above said plane and said carrying aperture is above said plane.

2. A window washer caddy according to claim 1 wherein said spindle is closer to one said end than to the other said end, and said free end of said spindle is above said plane.

3. A window washer caddy according to claim 3 wherein said hooks are mounted on the upper edge of one said side.

4. A window washer caddy according to claim 2 wherein said hooks are mounted on the upper edge of one said side, such that said hooks and said spindle are on opposite sides of said partition.

5. A window washer caddy according to claim 1 wherein said partition is equidistant from said sides.

* * * * *